US010035246B2

(12) United States Patent
Coffland et al.

(10) Patent No.: US 10,035,246 B2
(45) Date of Patent: Jul. 31, 2018

(54) METHOD AND APPARATUS FOR RELEASING A CABLE TIE

(71) Applicant: The Boeing Company, Chicago, IL (US)

(72) Inventors: Donald Coffland, Seattle, WA (US); Christine Anderson, Edmonds, WA (US); Curt Backman, Seattle, WA (US); Aaron Ayers, Granite Falls, WA (US); David Wright, Snohomish, WA (US); Scott Shapiro, Mill Creek, WA (US); Donald Young, Tulalip, WA (US)

(73) Assignee: The Boeing Company, Chicago, IL (US)

( * ) Notice: Subject to any disclaimer, the term of this patent is extended or adjusted under 35 U.S.C. 154(b) by 1100 days.

(21) Appl. No.: 14/288,868

(22) Filed: May 28, 2014

(65) Prior Publication Data

US 2015/0343609 A1 Dec. 3, 2015

(51) Int. Cl.

| | |
|---|---|
| ***B25B 7/04*** | (2006.01) |
| ***B25B 7/08*** | (2006.01) |
| ***B65B 13/02*** | (2006.01) |
| *B25B 7/02* | (2006.01) |

(52) U.S. Cl.

CPC ..... *B25B 7/04* (2013.01); *B25B 7/08* (2013.01); *B65B 13/027* (2013.01); *B25B 7/02* (2013.01)

(58) Field of Classification Search

CPC B25B 7/04; B25B 7/08; B25B 13/027; B25B 7/02; B25B 7/123; B25B 7/22; B25B 7/00

See application file for complete search history.

(56) References Cited

U.S. PATENT DOCUMENTS

| | | | | |
|---|---|---|---|---|
| 3,168,119 | A | 2/1965 | Schwester et al. | |
| 4,004,618 | A * | 1/1977 | Turek | B65B 13/027 140/93 A |
| 4,459,717 | A * | 7/1984 | Halstead | B25B 25/00 30/250 |
| 5,309,802 | A | 5/1994 | Mammosser | |
| 5,372,166 | A * | 12/1994 | Lai | B65B 13/027 140/123.6 |
| 5,632,312 | A * | 5/1997 | Hoffman | B21F 15/06 140/123.6 |

(Continued)

*Primary Examiner* — Peter DungBa Vo
*Assistant Examiner* — Danny Hong
(74) *Attorney, Agent, or Firm* — Joseph F. Harding; The Small Patent Law Group LLC

(57) ABSTRACT

One example of the present disclosure relates to a tool for releasing a cable tie. The tool includes a front member having a front indexing surface and a front extension member. The tool includes a rear member movably coupled to the front member, with the rear member including a rear indexing surface and a rear extension member. When the front member and the rear member engage a head of the cable tie in a closed state, the front extension member protrudes into an opening in the head, in an insertion direction, a front extension distance that is less than the length of the head minus a distance from the rear surface to a pawl of the cable tie along the insertion direction, and spaces a contact portion of the pawl, along a transverse direction, by a distance sufficient to disengage the cable tie.

27 Claims, 10 Drawing Sheets

(56) References Cited

U.S. PATENT DOCUMENTS

| | | | | |
|---|---|---|---|---|
| 5,769,133 | A * | 6/1998 | Dyer | B65B 13/027 140/123.6 |
| 5,832,964 | A * | 11/1998 | Joshi | B65B 13/027 140/123.6 |
| 5,845,681 | A * | 12/1998 | Kurmis | B65B 13/027 100/30 |
| 6,276,059 | B1 | 8/2001 | Kan | |
| 6,840,289 | B2 * | 1/2005 | Hillegonds | B65B 27/10 140/123.6 |
| 6,926,045 | B2 * | 8/2005 | Miyazaki | B65B 13/027 100/29 |
| 7,174,640 | B2 * | 2/2007 | Elkins | B26B 17/00 30/250 |
| D596,910 | S * | 7/2009 | Whitehead | D8/52 |
| 8,104,180 | B2 | 1/2012 | Swinford | |
| 8,365,418 | B2 * | 2/2013 | Tomasetti | B26B 17/00 30/254 |
| 2010/0206148 | A1 | 8/2010 | Reyes | |
| 2011/0265332 | A1 | 11/2011 | Cornell et al. | |
| 2013/0139392 | A1 | 6/2013 | Wright et al. | |

* cited by examiner

METHOD AND APPARATUS FOR RELEASING A CABLE TIE

BACKGROUND

Cable ties may be used to secure at least one cable or wire in place. The cable tie may include, for example, a pawl configured to engage a strap having teeth.

Removal of the installed cable tie, however, may be problematic. Conventionally, the cable tie may be removed by one or more techniques. For example, a sharp object, such as a razor blade or a knife, may be used to cut through the strap to release the cable tie. However, the sharp object may damage cables or other equipment retained by the cable tie and may present a safety risk for operators. Another conventional approach is to use a tool that cuts or otherwise damages the pawl of the cable tie, causing the pawl or a portion thereof to disengage from the strap. Accordingly, damaging the pawl may produce FOD (foreign-object debris), which is undesirable, for example, in aircraft applications.

SUMMARY

Accordingly, apparatus and method, intended to address the above-identified concerns, would find utility.

One example of the present disclosure relates to a tool for releasing a cable tie. The cable tie includes a head, a pawl, and a strap. The head includes an opening, with the pawl movably coupled to the head inside the opening. The strap has an inner side and an outer side, and includes teeth extending from the outer side of the strap. The head of the cable tie includes a front side that has a front surface and a rear side that has a rear surface. The strap is configured to be inserted through the opening from the front side to the rear side in an insertion direction to engage the pawl with the teeth. The head has a length equal to a maximum distance between the front surface and the rear surface along the insertion direction. The opening in the head has an inner surface that, when the strap is inserted in the opening, is on the outer side of the strap and is facing toward the strap. The head has an outer surface that, when the strap is inserted in the opening, is on the outer side of the strap and is facing away from the strap. The head has a maximum height equal to a maximum distance between the outer surface of the head and the inner surface of the opening along a transverse direction perpendicular to the insertion direction. The pawl is coupled to the inner surface of the opening a distance D1 from the rear surface along the insertion direction, and includes a contact extension having a contact portion spaced a distance D2 along the transverse direction from the inner surface with the strap inserted through the opening and engaging the pawl. The head has a minimum height equal to a minimum distance between the outer surface of the head and the inner surface of the head along the transverse direction. The tool includes a front member having a front indexing surface and a front extension member projecting from the front indexing surface. The tool also includes a rear member movably coupled to the front member, with the rear member including a rear indexing surface and a rear extension member projecting from the rear indexing surface. When the tool is in an open state, a shortest distance between the front extension member and the rear extension member along the insertion direction is greater than the length of the head. When the front member and the rear member engage the head of the cable tie with the tool in a closed state and the strap inserted through the opening, the front indexing surface of the front member contacts the front surface of the head, and the rear indexing surface of the rear member contacts the rear surface of the head. Further, with the tool in the closed state, the front extension member protrudes into the opening in the head, in the insertion direction, a front extension distance that is less than the length of the head minus the distance D1, and spaces the contact portion and the inner surface, along the transverse direction, by a distance D3 that is greater than the distance D2 and sufficient to disengage the pawl and the teeth of the strap. Also, with the tool in the closed state, the rear extension member protrudes into the opening in the head, in a direction opposite to the insertion direction, a rear extension distance that is less than the distance D1.

One example of the present disclosure relates to a method of using a tool to release a cable tie fastened around an object. The cable tie includes a head, a pawl, and a strap. The head includes an opening, with the pawl movably coupled to the head inside the opening. The strap has an inner side and an outer side and includes teeth extending from the outer side of the strap. The head of the cable tie includes a front side that has a front surface and a rear side that has a rear surface. The strap is configured to be inserted through the opening from the front side to the rear side in an insertion direction to engage the pawl with the teeth. The opening in the head has an inner surface that, when the strap is inserted in the opening, is on the outer side of the strap and is facing toward the strap. The pawl includes a contact extension having a contact portion spaced a distance D2 along a transverse direction, perpendicular to the insertion direction, from the inner surface with the strap inserted through the opening and engaging the pawl. The method includes gripping the head of the cable tie with the tool. The method also includes exerting a force on the contact portion of the pawl with the tool, wherein the force includes a first component in the insertion direction and a second component perpendicular to the first component and directed toward the outer side of the strap, and wherein the force is sufficient to disengage the pawl and the teeth of the strap and a travel of a front extension member of the tool is insufficient to detach the pawl from the head. The method also includes pulling the head of the cable tie away from the object with the tool until the strap is withdrawn from the opening in the head.

BRIEF DESCRIPTION OF THE DRAWINGS

Having thus described examples of the disclosure in general terms, reference will now be made to the accompanying drawings, which are not necessarily drawn to scale, and wherein like reference characters designate the same or similar parts throughout the several views, and wherein:

FIG. 1 is a block diagram of a tool for releasing a cable tie, according to one aspect of the present disclosure;

FIG. 2 is a schematic side elevation view of the tool of FIG. 1, according to one aspect of the disclosure;

FIG. 3A is a schematic sectional view of the tool of FIG. 1, with the tool in an open state, according to one aspect of the disclosure;

FIG. 3B is a schematic sectional view of the tool of FIG. 1, with the tool in an intermediate state, according to one aspect of the disclosure;

FIG. 3C is a schematic sectional view of the tool of FIG. 1, with the tool in closed state, according to one aspect of the disclosure;

Figure 1:
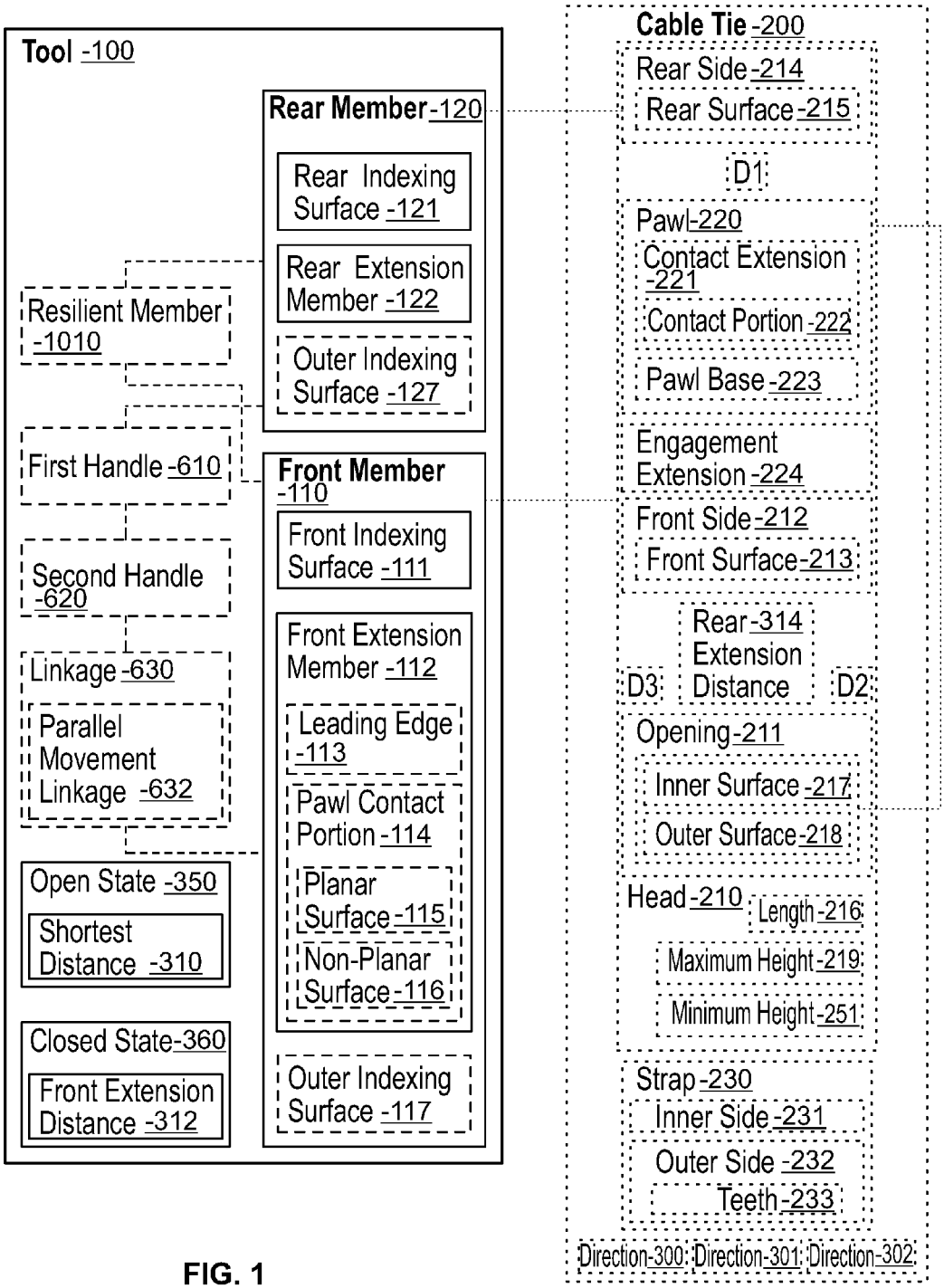
Figure 2:
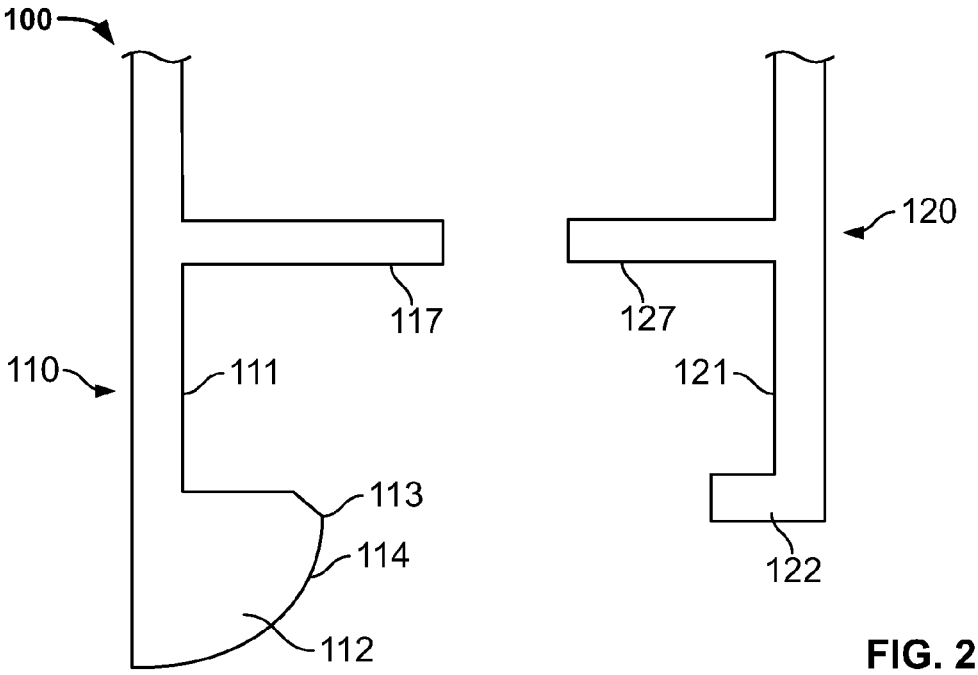
Figure 4:
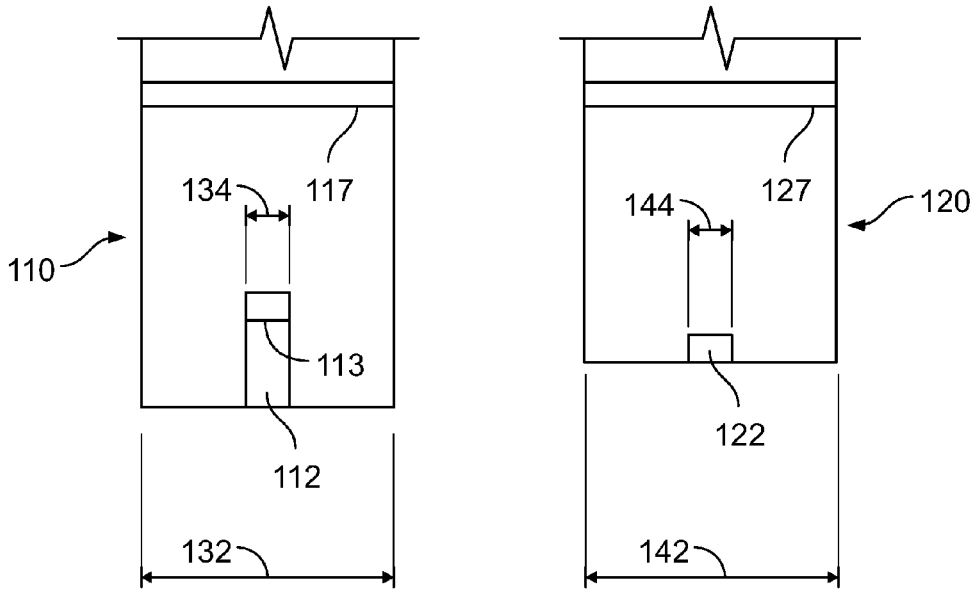
Figure 5A:
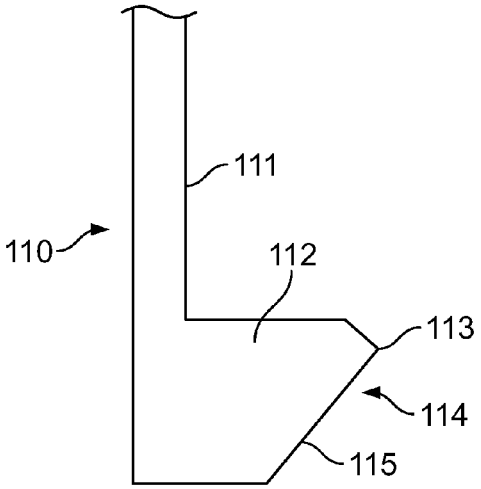
Figure 5B:
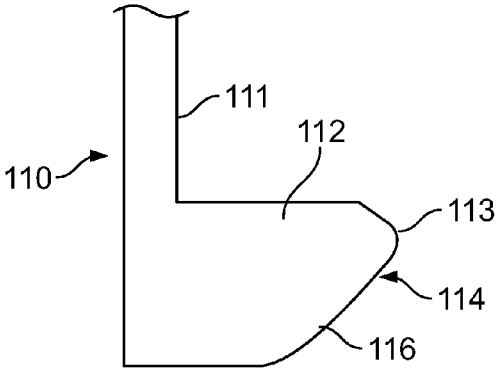
Figure 6:
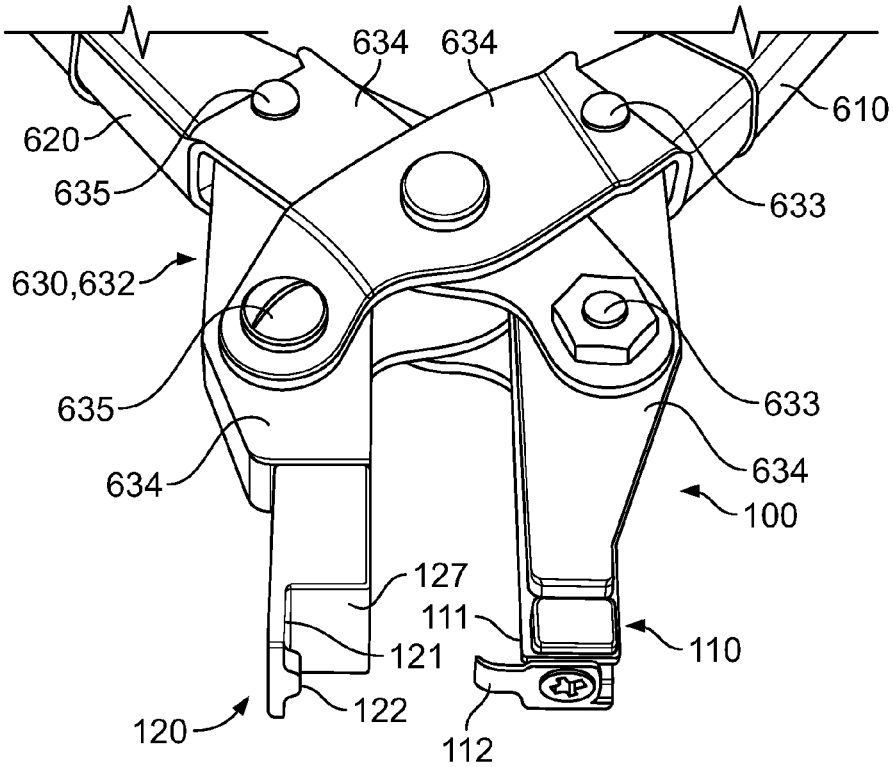
Figure 7:
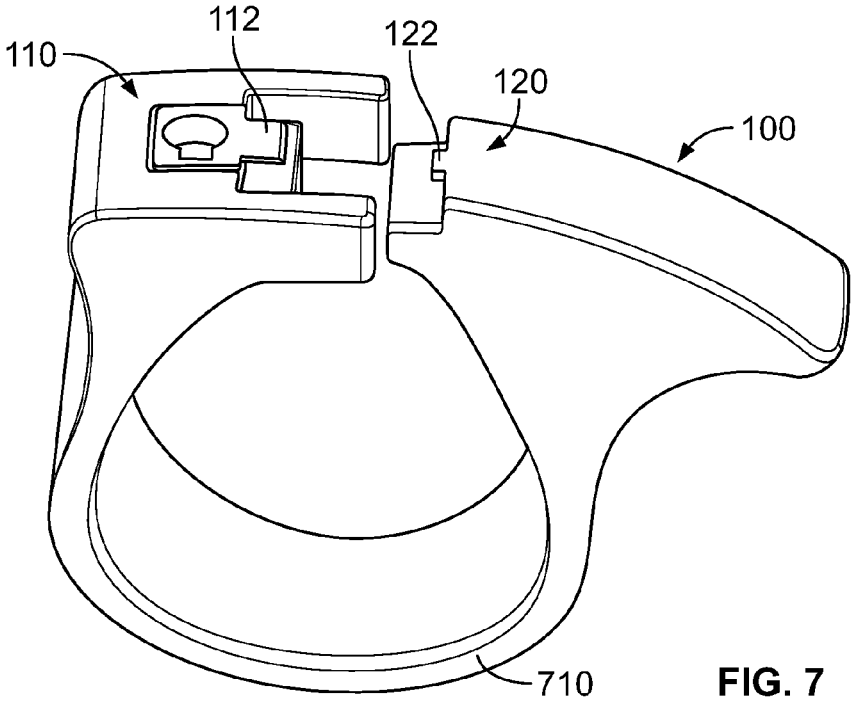
Figure 8:
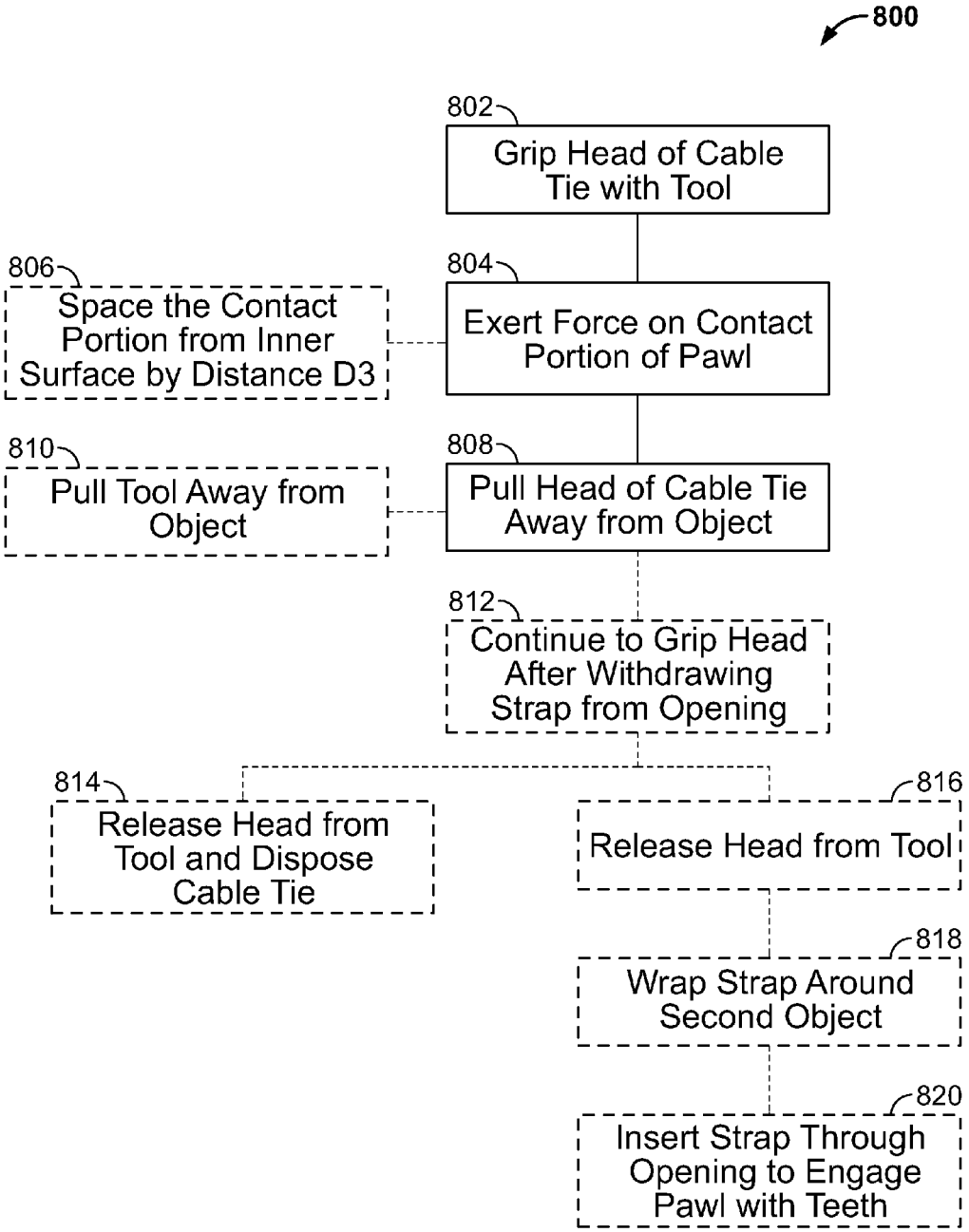
Figure 9:
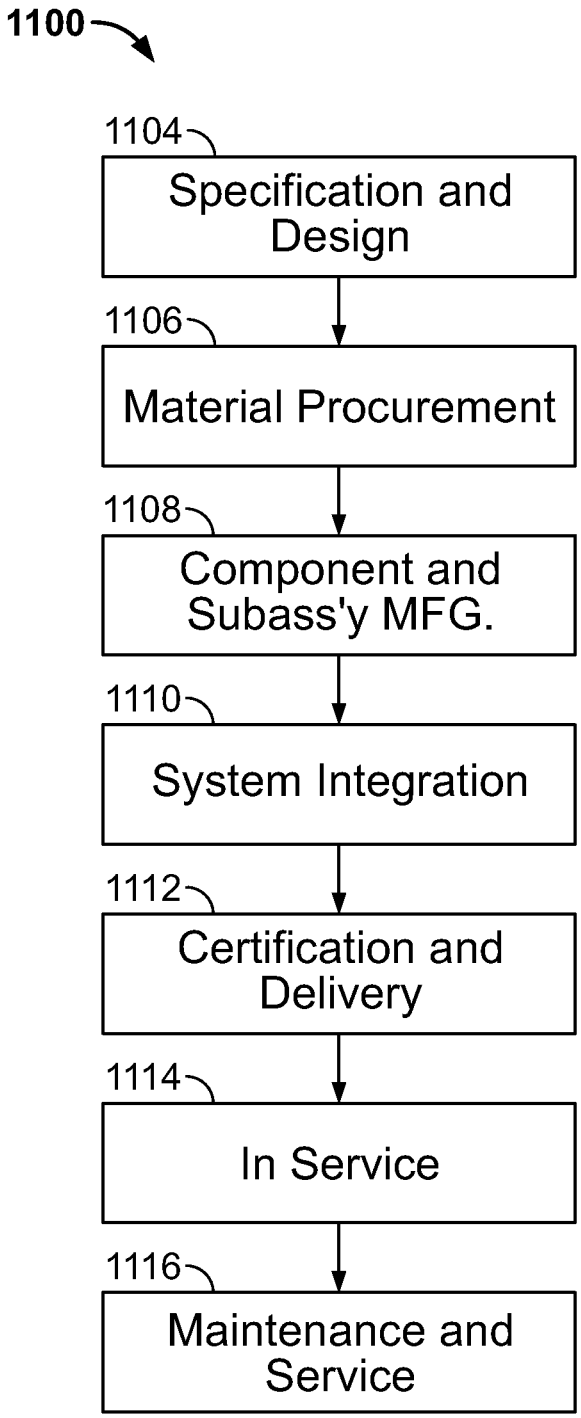
Figure 10:
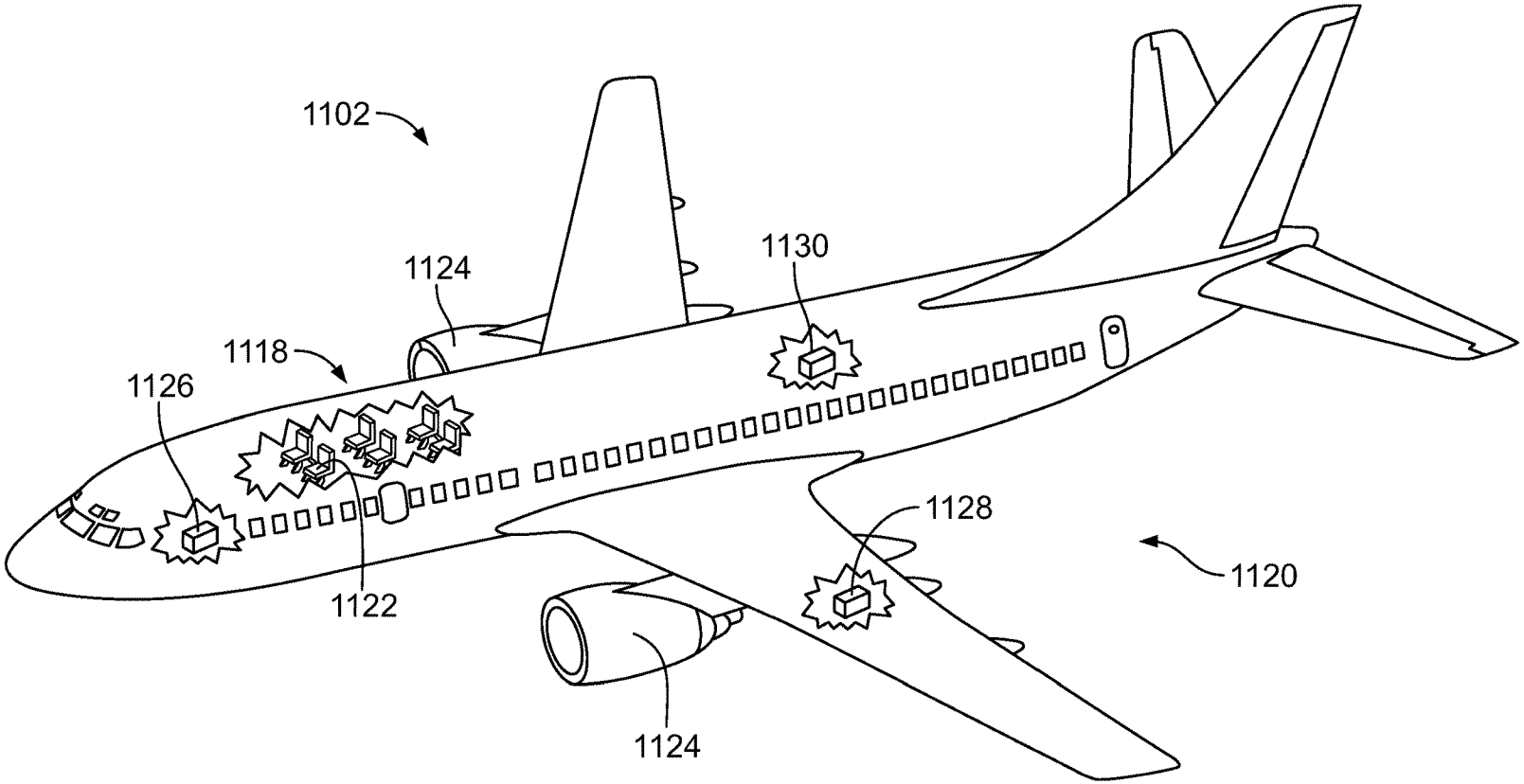

FIG. 4 provides schematic elevation views of the front member and the rear member shown in FIG. 2 as seen from an interior of the tool, according to one aspect of the disclosure;

FIG. 5A is a schematic view of a planar pawl contact portion of a front member of the tool shown in FIG. 1, according to one aspect of the disclosure;

FIG. 5B is a schematic view of a non-planar pawl contact portion of a front member of the tool shown in FIG. 1, according to one aspect of the disclosure;

FIG. 6 is a schematic perspective view of the tool of FIG. 1, including a parallel movement linkage, according to one aspect of the disclosure;

FIG. 7 is a schematic perspective view of the tool of FIG. 1, including a resilient member, according to one aspect of the disclosure;

FIG. 8 is a block diagram of a method for releasing a cable tie, according to one aspect of the disclosure;

FIG. 9 is a block diagram of aircraft production and service methodology; and FIG. 10 is a schematic illustration of an aircraft.

In the block diagram(s) referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. Couplings other than those depicted in the block diagrams may also exist. Dashed lines, if any, connecting the various elements and/or components represent couplings similar in function and purpose to those represented by solid lines; however, couplings represented by the dashed lines may either be selectively provided or may relate to alternative or optional aspects of the disclosure. Likewise, elements and/or components, if any, represented with dashed lines, indicate alternative or optional aspects of the disclosure. Environmental elements, if any, are represented with dotted lines.

In the block diagram(s) referred to above, the blocks may also represent operations and/or portions thereof. Lines connecting the various blocks do not imply any particular order or dependency of the operations or portions thereof.

DETAILED DESCRIPTION

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Reference herein to "one example" or "one aspect" means that one or more feature, structure, or characteristic described in connection with the example or aspect is included in at least one implementation. The phrase "one example" or "one aspect" in various places in the specification may or may not be referring to the same example or aspect.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Referring generally to FIGS. 1-3, and with particular reference to FIG. 1, one example of the present disclosure relates to a tool 100 for releasing a cable tie 200. The cable tie 200 includes a head 210, a pawl 220, and a strap 230. The head 210 includes an opening 211, with the pawl 220 movably coupled to the head 210 inside the opening 211. The strap 230 has an inner side 231 and an outer side 232, and includes teeth 233 extending from the outer side 232 of the strap 230. The head 210 of the cable tie 200 includes a front side 212 that has a front surface 213 and a rear side 214 that has a rear surface 215. The strap 230 is configured to be inserted through the opening 211 from the front side 212 to the rear side 214 in an insertion direction 300 to engage the pawl 220 with the teeth 233. The head 210 has a length 216 equal to a maximum distance between the front surface 213 and the rear surface 215 along the insertion direction 300. The opening 211 in the head 210 has an inner surface 217 that, when the strap 230 is inserted in the opening 211, is on the outer side 232 of the strap 230 and is facing toward the strap 230. The head 210 has an outer surface 218 that, when the strap 230 is inserted in the opening 211, is on the outer side 232 of the strap 230 and is facing away from the strap 230. The head 210 has a maximum height 219 equal to a maximum distance between the outer surface 218 of the head 210 and the inner surface 217 of the opening 211 along a transverse direction 302 perpendicular to the insertion direction 300. The pawl 220 is coupled to the inner surface 217 of the opening 211 a distance D1 from the rear surface 215 along the insertion direction 300, and includes a contact extension 221 having a contact portion 222 spaced a distance D2 along the transverse direction 302 from the inner surface 217 with the strap 230 inserted through the opening 211 and engaging the pawl 220. The head 210 has a minimum height 251 equal to a minimum distance between the outer surface 218 of the head 210 and the inner surface 217 of the head 210 along the transverse direction 302. The tool 100 includes a front member 110 having a front indexing surface 111 and a front extension member 112 projecting from the front indexing surface 111. The tool 100 also includes a rear member 120 movably coupled to the front member 110, with the rear member 120 including a rear indexing surface 121 and a rear extension member 122 projecting from the rear indexing surface 121. When the tool 100 is in an open state 350, a shortest distance 310 between the front extension member 112 and the rear extension member 122 along the insertion direction 300 is greater than the length 216 of the head 210. When the front member 110 and the rear member 120 engage the head 210 of the cable tie 200 with the tool 100 in a closed state 360 and the strap 230 inserted through the opening 211, the front indexing surface 111 of the front member 110 contacts the front surface 213 of the head 210, and the rear indexing surface 121 of the rear member 120 contacts the rear surface 215 of the head 210. Further, with the tool 100 in the closed state 360, the front extension member 112 protrudes into the opening 211 in the head 210, in the insertion direction 300, a front extension distance 312 that is less than the length 216 of the head 210 minus the distance D1, and spaces the contact portion 222 and the inner surface 217, along the transverse direction 302, by a distance D3 that is greater than the distance D2 and sufficient to disengage the pawl 220 and the teeth 233 of the strap 230. Also, with the tool 100 in the closed state 360, the rear extension member 122 protrudes into the opening 211 in the head 210, in a direction 301 opposite to the insertion direction 300, a rear extension distance 314 that is less than the distance D1.

Generally, the front extension member 112 contacts the pawl 220 and actuates the pawl 220 out of engagement with the teeth 233 of the strap 230 as the tool 100 is moved to the closed state 360 with the cable tie 200 properly oriented and gripped between the front member 110 and the rear member 120 of the tool 100. As the front extension member 112 protrudes into the opening 211, in the closed state 360, by the front extension distance 312, and as the front extension distance 312 is less than the length of the head 210 minus the distance D1, the front extension member 112 does not travel through the entire thickness of the joint of the pawl 220 with the head 210. If the front extension member 112 protruded through the entire thickness of the joint of the pawl 220 with the head 210, the pawl 220 would be sheared, sliced, cut, torn, or otherwise separated from the head 210 when the tool 100 was placed in the closed state 360. The front extension distance 312 may be selected or determined such that the front extension member 112 does not protrude far enough into the opening to shear or otherwise separate the pawl 220 from the head 210, and/or so that the pawl 220 is not damaged. For example, the front extension distance 312 may be selected or designed such that the pawl 220 is only biased or deflected an amount that does not shear, permanently deform, mangle, or otherwise permanently damage the pawl 220 or other aspect of the cable tie 200.

For example, the cable tie 200 may be made of a resilient material, such that, after the pawl 220 is actuated by the front extension member 112 from an original position corresponding to engagement of the pawl 220 with the strap 230, the pawl 220 may resiliently spring back to the original position (or near to the original position if the strap 230 is removed while the front extension member 112 biases the pawl 220 out of an engagement position) when the front extension member 112 is withdrawn from the opening 211 of the head 210 of the cable tie 200.

The front extension member 112 (e.g., the front extension distance 312) may be sized and configured so that, when the tool 100 is in the closed state, the pawl 220 is not actuated past a threshold or limit beyond which the pawl 220 is damaged or otherwise not able to return to the original position. Thus, the pawl 220 may be understood as non-destructively biased by the front extension member 112. As a result, when the front extension member 112 is withdrawn from the opening 211, the pawl 220 returns to or substantially near to an original, or default, position at which the strap 230 may be engaged by the pawl 220 when the strap 230 is inserted into the opening 211 in the insertion direction 300. Thus, the cable tie 200 may be re-used after being released from an object (e.g., bundle of cables or wires) using the tool 100. Even if the cable tie 200 is not re-used, the cable tie 200 may be disposed of with the pawl 220 still intact (e.g., connected to the head 210), with no debris formed or separated from the cable tie 200, thereby reducing or eliminating the creation of debris from the release of the cable tie 200.

The pawl 220 and cable tie 200 may be made of a resilient material (e.g., a material that may be biased responsive to a force and resiliently return to an original shape or configuration when the force is removed), such as resilient plastic. The tool 100, or portions thereof (e.g., the front extension member 112) may be made of a metal or other sufficient rigid material, so that, when the front extension member 112 is urged against the contact extension 222 of the pawl 220, the pawl 220 biases to disengage the pawl 220 from the strap 230, and the front extension member 112 does not bias or deflect, or biases or deflects a negligible amount that does not interfere with the disengagement of the pawl 220 from the strap 230.

In the illustrated example, the front extension member 112 provides for biasing of the pawl 220, and also provides a surface with which the cable tie 200 may be pulled away from an object around which a cable tie 200 (with the strap 230 released from the pawl 220) can be pulled away. In the illustrated example, the rear extension member 122 helps prevent the cable tie 200 from cocking when the front extension member 112 is urged against the contact extension 221 of the pawl 220, so that the pawl 220 is biased away from engagement with the strap 230, instead of the entire cable tie 200 cocking or tilting responsive to contact between the front extension member 112 and the contact extension 221. Similar to the front extension member 112, the depicted rear extension member 122 also provides a surface with which the cable tie 200 may be pulled away from an object around which a cable tie 200 (with the strap 230 released from the pawl 220) can be pulled away. It may be noted that "front" and "rear" as used herein are arbitrary labels used for clarity of description with respect to the illustrated examples. In other examples, one or more aspects of a component positioned or oriented toward a "front" of a device or system may include one or more "rear" components or aspects as described herein, or vice versa.

Figure 3A:
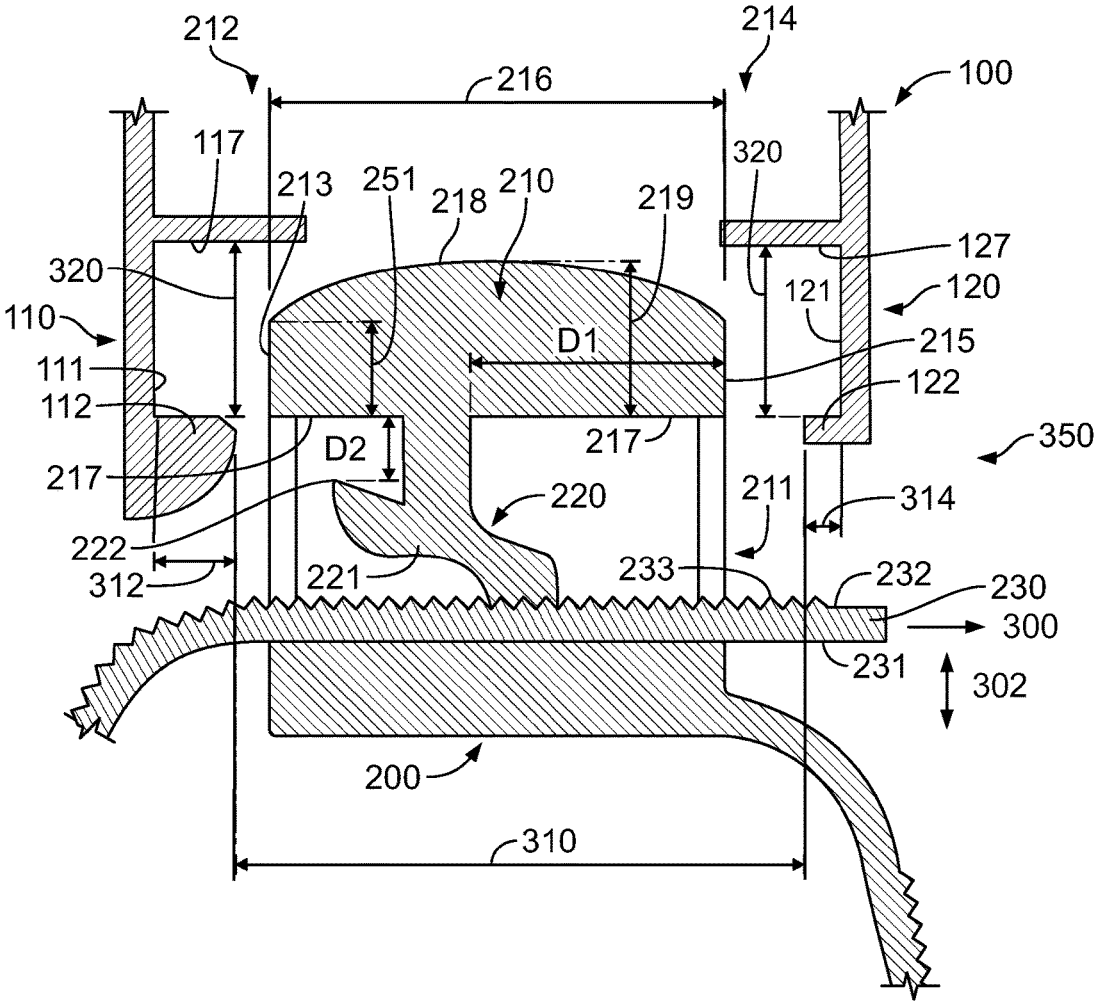

Referring particularly to FIGS. 2 and 3A, in one aspect of the disclosure, which may include at least a portion of the subject matter of any of the preceding and/or following examples and aspects, at least one of the front member 110 and the rear member 120 includes an outer indexing surface 117, 127 spaced from at least one of the front extension member 112 and the rear extension member 122, along the transverse direction 302, a minimum distance 320 not less than the minimum height 251 of the head 210 and not exceeding the maximum height of the head 210.

As seen, for example, in FIGS. 2 and 3A, the illustrated tool 100 includes the outer indexing surface 117 of the front member 110 and the outer indexing surface 127 of the rear member 120. Thus, in the illustrated embodiment, both the front member 110 and the rear member 120 have an outer indexing surface; however, in other examples, only the front member 110 or only the rear member 120 may have an outer indexing surface. Generally, the outer indexing surfaces 117, 127 provide improved guidance and grip between the tool 100 and the cable tie 200 as the tool 100 is urged toward the closed state 360 and/or as the cable tie 200 is removed from an object after the strap 230 is released from engagement with the pawl 220. The minimum distance 320 may be more than the minimum height 251 of the head 210 to allow the head 210 to be positioned between the outer indexing surface 117, 127 and the corresponding front extension member 112 or rear extension member 122. The minimum distance 320 may be less than the maximum height 219 to provide for some compression to increase the security of grip between the tool 100 and the head 210 as the tool is moved to the closed state 360. Alternatively, the minimum distance 320 may be the maximum height 219 to provide for easier fitment of the head 210 in the tool 100, while still providing for guidance and the restraint of excessive twisting or cocking of the head 210 within the tool 100 as the tool 100 is urged toward or maintained in the closed state 360. In some example, the tool 100 may be configured for use with multiple differently sized heads. In such examples, the tool 100 may be designed such that the minimum distance 320 is sized for the largest of the heads (e.g., the head having the largest minimum height 251).

Referring particularly to FIG. 4, in one aspect of the disclosure, which may include at least a portion of the subject matter of any of the preceding and/or following examples and aspects, the outer indexing surface 117, 127 is wider than the front extension member 112 and the rear extension member 122. For example, as depicted in FIG. 4, the front member 110 has an overall width 132 and a front extension width 134, with the overall width 132 (e.g., a width of the front indexing surface 111 and/or outer indexing surface 117) being greater than the front extension width 134. Similarly, the rear member 120 has an overall width 142 (e.g., a width of the rear indexing surface 121 and/or outer indexing surface 127) and a rear extension width 144 that is less than the overall width 142. Utilizing narrower extensions (e.g., narrower than indexing surfaces from which the extensions protrude) that are configured for insertion into the opening 211 (e.g., front extension member 112, rear extension member 122) allows for insertion and placement of the extension members into the opening 211 while allowing outer indexing surfaces to have increased area or bearing surface for improved grip of the front surface 213 and rear surface 215 of the head 210 of the cable tie 200, and/or additional stability during use or prevention of cocking or tilting of the head 210 of the cable tie 200 with respect to the tool 100. It may be noted that the extension members are depicted as generally centered relative to the indexing surfaces in the illustrated example; however, in other examples one or more extension members may be non-centered, or offset toward a side or edge of a corresponding indexing surface (e.g., an indexing surface from which the extension member protrudes).

Referring particularly to FIG. 2, in one aspect of the disclosure, which may include at least a portion of the subject matter of any of the preceding and/or following examples and aspects, the front extension member 112 projects directly from the front indexing surface 111 and the rear extension member 122 projects directly from the rear indexing surface 121. A given extension member and corresponding indexing surface from which the extension member projects may be formed from a single piece (e.g., cast, molded, or the like), or may be joined (e.g., via welding, one or more fasteners, or the like). The indexing surfaces, for example, may be shaped to match or otherwise correspond to a corresponding side of the cable tie 200. For example, the front indexing surface 111 may be shaped to match or correspond to the front side 212, and the rear indexing surface 121 may be shaped to match or correspond to the rear side 214 of the head 210 of the cable tie 200.

Figure 3B:
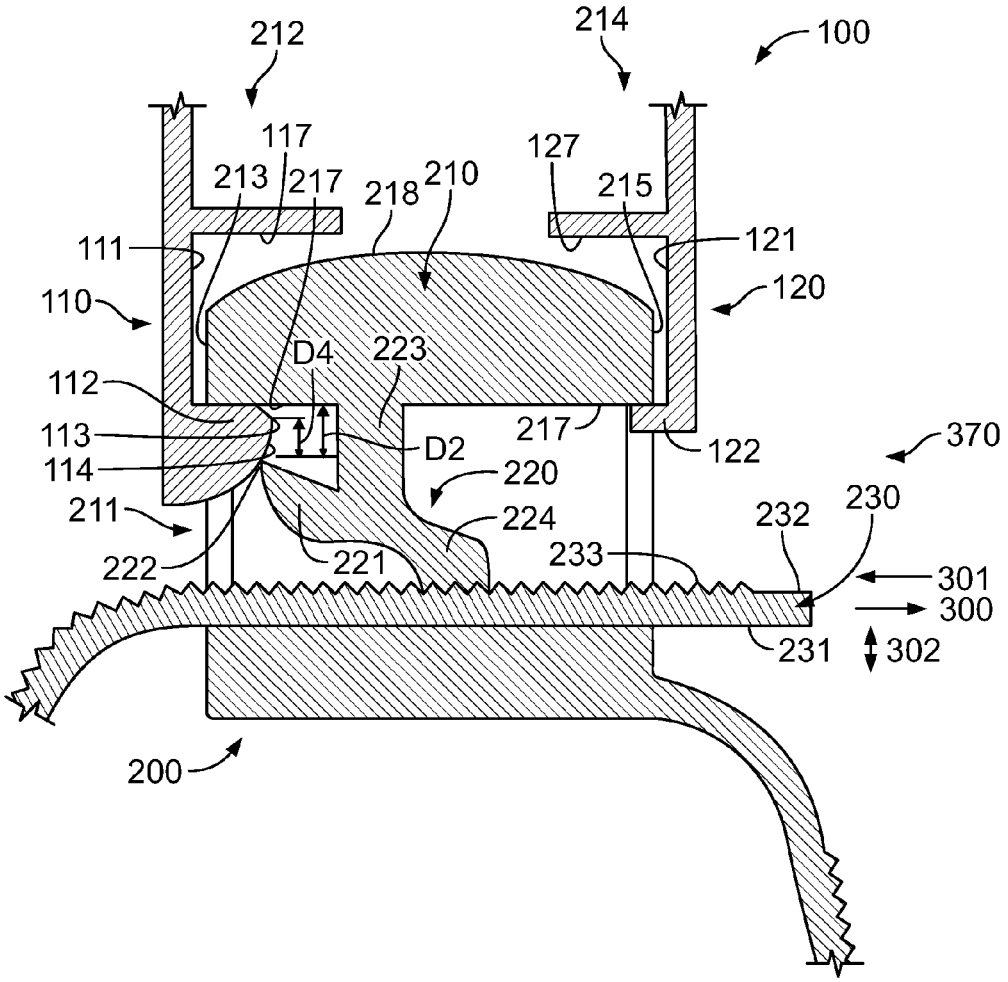
Figure 3C:
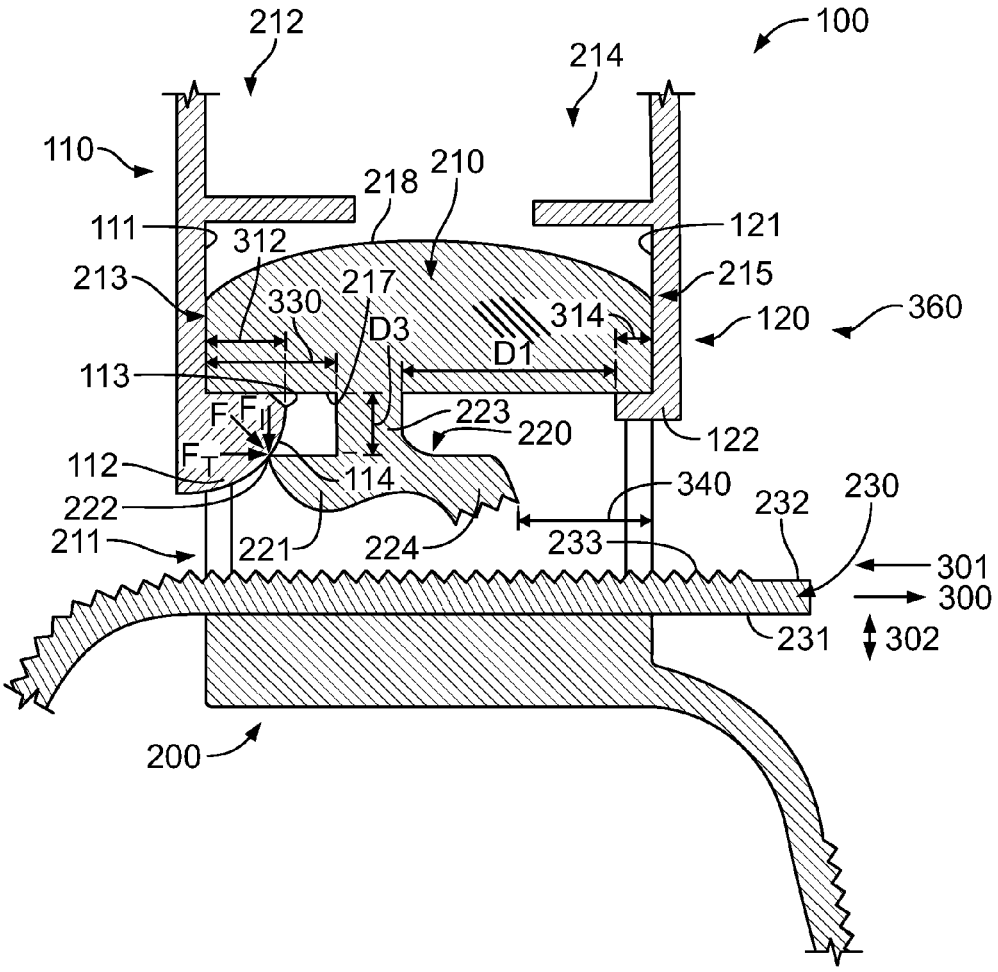

In the illustrated embodiment, the front side 212 and rear side 214 of the head may form generally right angles with the opening 211 of the head 210 of the cable tie 200. Accordingly, referring particularly to FIGS. 2 and 3A-C, in one aspect of the disclosure, which may include at least a portion of the subject matter of any of the preceding and/or following examples and aspects, the front extension member 112 projects substantially perpendicularly from the front indexing surface 111 and the rear extension member 122 projects substantially perpendicularly from the rear indexing surface 121. It may be noted that other arrangements or configurations may be employed in alternate examples. For example, one or more surfaces of the front extension member 112 may extend at a non-perpendicular angle or taper from the front indexing surface 111. In some examples, the portion of the front extension member 112 inserted deepest into the opening 211 may have a clearance from the inner surface 217 to ease insertion of the front extension member 112 into the opening 211, while the portion closest the front indexing surface 111 may be at or near the inner surface 217 to help securely grip the head 210 as well as to properly position the front extension member 112 to bias the pawl 220 to a desired position to disengage the pawl 220 from the strap 230. As seen in FIG. 3A-3C, the front indexing surface 111 and the rear indexing surface 121 may have contours that substantially match the contours of the front side 212 and the rear side 214, respectively, of the head 210. For example, the front side 212, rear side 214, front indexing surface 111, and rear indexing surface 121 may have substantially planar contours oriented along the transverse direction 302 when the tool 100 is in the closed state 360.

As seen in FIGS. 3A, 3B, and 3C, for example, the tool 100 is movable between a number of states. It may be noted that the depicted states are illustrative and not exhaustive of states or positions of the tool 100, and that additional states are possible. As just one example, the tool 100 may be movable to a state or position in which the front extension member 112 and rear extension member 122 are closer than shown in the closed state 360 when no cable tie 200 is positioned between the front member 110 and the rear member 120. The ability of the tool 100 to be positioned with the front member 110 and the rear member 120 closer to each other than in the closed state 360 may allow for additional pressure to be placed on cable tie 200 when in closed state 360 (e.g., the cable tie 200 may be slightly squeezed inwardly) for improved friction or grip between the front indexing surface 111 (and/or rear indexing surface 121) and the cable tie 200.

As seen in FIG. 3A, when in the open state 350, the front member 110 and the rear member 120 are separated by the shortest distance 310 that is greater than the length 216 of the head 210 of the cable tie 200. With the front member 110 and the rear member 120 thus spaced apart, the tool 100 may be placed in a desired position proximate the cable tie 200 prior to urging the tool to the closed state 360 to release the cable tie 200 from an object (e.g., one or more cables or wires) secured by the cable tie 200. Further, in the open state 350, the tool 100 may be released from the cable tie 200 or the cable tie 200 may be removed from the grip or control of the tool 100 after the cable tie 200 has been released from the object (e.g., the cable tie 200 may be placed in a bag or other container for disposal or storage for later re-use).

To grasp the cable tie 200 with the tool 100 and to release the cable tie 200 (e.g., to disengage the pawl 220 from the strap 230), the tool 100 is moved toward the closed state 360 by urging the front member 110 and the rear member 120 toward each other (e.g., the front extension member 112 is inserted into the opening 211 and urged in the insertion direction 300 toward the pawl 220). As the front extension member 112 continues to travel into the opening 211 in the insertion direction, the front extension member 112 is brought into contact with the pawl 220.

Referring particularly to FIG. 3B, in one aspect of the disclosure, which may include at least a portion of the subject matter of any of the preceding and/or following examples and aspects, the front extension member 112 includes a leading edge 113. When the front member 110 initially contacts the contact portion 222 of the contact extension 221 with the tool 100 in an intermediate state 370 between the open state 350 and the closed state 360, the leading edge 113 is spaced a distance D4 from the contact portion 222 along the transverse direction 302, wherein the distance D4 is less than the distance D2.

Thus, in the depicted example, the leading edge 113 may be positioned between the pawl 220 (e.g., the contact extension 221 of the pawl 220) and the inner surface 217, helping to provide a correct orientation between the front extension member 112 and the contact portion 222 of the pawl 220, resulting in the urging of contact extension 221 in the correct direction (e.g., downward as seen in FIGS. 3B and 3C to urge pawl 220 out of contact with teeth 233, and not upward as seen in FIGS. 3B and 3C, which would urge the pawl into further engagement with the teeth 233 of the strap 230) as the front extension member 112 is inserted into the opening 211 and presses against the contact extension 221 of the pawl 220. Further, the leading edge 113, by being positioned between the contact extension 221 and the inner surface 217, helps prevent insertion or wedging of the front extension member 112 between the pawl 220 and the outer side 232 of the strap 230. Such a wedging between the contact extension 221 and the strap 230 may potentially release the pawl 220 from the teeth 233, but will inhibit or prevent removal of the strap 230 from the head 210, and thus may result in improper functioning of a release tool. By positioning the leading edge 113 between the contact extension 221 and the inner surface 217, for example, various embodiments provide improved reliability and effectiveness of the tool 100. The depicted leading edge 113 is disposed a distance from the inner surface 217, providing a chamfer or guide for improved ease of insertion of the front extension member 112 relative to the inner surface 217 of the head 210. From the intermediate state 370, the tool 100 may be advanced to the closed state 360. It may be noted that the contact portion 222 may be a point or surface (or include plural surfaces, such as steps). The contact portion 222, for example, may include a surface (e.g., a rounded surface), with the precise point of contact between the pawl 220 and the front extension member 112 changing as the front extension member 112 is urged into the opening 211 and the pawl 220 is biased away from engagement with the strap 230.

It may be noted that in the intermediate state 370, as seen in FIG. 3B, there is still a clearance or space between the front and rear indexing surfaces 111, 121 and the corresponding front and rear surfaces 213, 215. To bias the pawl 220 (e.g., rotate, pivot, or otherwise actuate the pawl 220 out of engagement with the strap 230), the front member 110 and the rear member 120 are urged toward each other until the front indexing surface 111 contacts the front surface 213, and the rear indexing surface 121 contacts the rear surface 215. While still in the intermediate state 370 depicted in FIG. 3B, the front extension member 112 and the rear extension member 121 have entered or at least partially penetrated the opening 211. With the extension members within the confines of the opening 211, as the front extension member 112 is urged against the contact extension 221 as the tool 100 is moved toward the closed state 360 from the intermediate state 370, the cable tie 200 is restrained or impeded from cocking or tilting relative to the tool 100 via interaction between the head 210 and the extension members and/or outer indexing surfaces, and the force with which the front extension member 112 is urged against the contact extension 221 is directed to bias the pawl 220 (e.g., pivot the pawl 220 relative to the head 210), and not to cock or tilt the head 210 with respect to the front member 110 and the rear member 120. Once the indexing surfaces contact the front and rear surfaces of the head 210, the tool 100 is in the closed state 360, and the front and rear extension members are impeded or prevented from further penetration into the opening 211, and the head 210 is securely gripped between the front member 110 and the rear member 120.

Referring particularly to FIG. 3C, in one aspect of the disclosure, which may include at least a portion of the subject matter of any of the preceding and/or following examples and aspects, the front extension member 112 includes a pawl contact portion 114 configured to contact the contact portion 222 of the pawl 220, wherein, when the front member 110 and the rear member 120 engage the head 210 of the cable tie 200 with the tool 100 in the closed state 360, the pawl contact portion 114 of the front extension member 112 is not parallel to the insertion direction 300.

The slope or taper of the pawl contact portion 114 allows for gradually increased biasing of the pawl 220 as the front extension member 112 is inserted further into the opening 211. As the front extension member 112 is inserted into the opening, and the pawl contact portion 114 slides inwardly relative to the contact portion 222 of the contact extension 221 of the pawl 220, the pawl contact portion 114 exerts a downward force upon the contact extension as seen in FIG. 3C. The amount of slope or taper of the pawl contact portion 114 may be used to control the force applied to the pawl 220 or the amount of bias of the pawl 220 (or a rate of change of the force or amount of bias) as the front extension member 112 is inserted into the opening 211. The slope or taper of the pawl contact portion 114 may also provide easier placement of the front extension member 112 into the opening 211, providing a chamfer or guide between the front extension member 112 and the contact extension 221 of the pawl 220. The particular shape and/or dimensions of the pawl contact portion 114 (and/or other aspects of the front extension member 112) may be sized to cooperate with the particular geometry of the contact portion 222 of the pawl 220 for a given application or applications. Generally, the pawl contact portion 114 may be configured to provide a desired amount of bias to bring the pawl 220 out of engagement with the strap 230, while not damaging the pawl 220, separating the pawl 220 from the head 210, or biasing the pawl 220 past a threshold beyond which the pawl 220 may not return at or near an original unbiased position.

Referring particularly to FIG. 3C, in one aspect of the disclosure, which may include at least a portion of the subject matter of any of the preceding and/or following examples and aspects, the pawl contact portion 114 extends along the transverse direction 302 toward the inner surface 217 of the head 210 and along the insertion direction 300 toward the rear member 120, wherein, when the tool 100 is in the closed state 360, the pawl contact portion 114 exerts a force F on the contact portion 222 of the pawl 220, the force F including a first component FI in the insertion direction 300 and a second component FT perpendicular to the first component FI and directed toward the outer side 232 of the strap 230.

In the illustrated embodiment, the downward force (FT) is positioned to provide for pivoting of the pawl 220, resulting in tensile forces between the pawl 220 and the head 210, while reducing any resulting shear that may separate the pawl 220 from the head 210. The force in the insertion direction (FI) may result in some amount of shear between the pawl 220 and the head 210. The particular shape or slope of the pawl contact portion 114 may be configured to provide sufficient forces to pivot the pawl 220 while maintaining any resulting shear below a desired threshold to help prevent separation of the pawl 220 from the head 210.

Referring particularly to FIG. 5A, in one aspect of the disclosure, which may include at least a portion of the subject matter of any of the preceding and/or following examples and aspects, the pawl contact portion 114 includes a planar surface 115. The particular positioning and slope of the planar surface 115 may be configured to be suited for a given application (e.g., a given geometry and resiliency of a corresponding pawl 220 to be biased out of engagement with a corresponding strap 230). Generally, the slope of the planar surface 115 may be configured to provide enough rise or motion over an available length to avoid separation of the pawl 220 from the head 210 while biasing the pawl 220 out of engagement with the teeth 233 of the strap 230. Overly low slopes (e.g., relatively flat) may not provide for sufficient disengagement of the pawl 220 from the strap 230, while overly high slopes (e.g., relatively steep) may result in damage to the pawl 220.

Referring particularly to FIG. 5B, in one aspect of the disclosure, which may include at least a portion of the subject matter of any of the preceding and/or following examples and aspects, the pawl contact portion 114 includes a non-planar surface 116. The particular shape or curvature of the non-planar surface 116 may be configured to be suited for a given application (e.g., a given geometry and resiliency of a corresponding pawl 220 to be biased out of engagement with a corresponding strap 230). Generally, the shape or curvature of the non-planar surface 116 may be configured to provide enough rise or motion over an available length to avoid separation of the pawl 220 from the head 210 while biasing the pawl 220 out of engagement with the teeth 233 of the strap 230. It may be noted that in some examples, for instance, the pawl contact portion 114 may include steps or other portions not sloped, tapered, or curved the same as other portions of the pawl contact portion 114. It may be further noted that the pawl contact portion 114 in some examples may include one or more planar surfaces as well as one or more non-planar surfaces to provide a desired amount of biasing (or rate of change of biasing) of the pawl 220.

Referring particularly to FIG. 3C, in one aspect of the disclosure, which may include at least a portion of the subject matter of any of the preceding and/or following examples and aspects, the front extension distance 312 is less than a minimum distance 330 along the insertion direction 300 from the front surface 213 of the head 210 to a pawl base 223. Utilizing a front extension distance 312 that is less than the minimum distance 330 helps insure the prevention of contact between the front extension member 112 and the pawl base 223 about which the pawl 220 pivots. With the front extension distance 312 less than the minimum distance 330, the front indexing surface 111 provides a positive stop preventing the front extension member 112 from entering the opening 211 far enough to contact the pawl base 223, helping to eliminate or reduce the possibility of shearing or slicing the pawl 220 from the head 210 by the front extension member 112.

Additionally or alternatively, the rear extension member 122 may be sized to provide clearance from the pawl 220 when the tool 100 is in the closed state 360. For example, referring particularly to FIG. 3C, in one aspect of the disclosure, which may include at least a portion of the subject matter of any of the preceding and/or following examples and aspects, the rear extension distance 314 is less than a minimum distance 340 along the insertion direction 300 from the rear surface 215 of the head 210 to an engagement extension 224 of the pawl 220. The engagement extension 224 is configured to engage the teeth 233 of the strap 230 to maintain the strap 230 in position in the head 210 when the pawl 220 engages the strap 230. The engagement extension 224, for example, may have one or more grooves, recesses, or the like configured to cooperate with the teeth 233 to maintain the strap 230 in a desired position (e.g., to secure an object within the cable tie 200. In the embodiment depicted in FIG. 3C, the engagement extension 224 is disposed on an opposite side of the pawl base 223 from the contact extension 221, such that the engagement extension 224 pivots upward and out of engagement with the teeth 233 when the contact extension 221 is urged downward as shown in FIG. 3C. Utilizing a rear extension distance 314 that is less than the minimum distance 340 helps prevent the rear extension member 122 from impeding or interfering with the travel or motion of the engagement extension 224 upward and out of engagement with the teeth 233 of the strap 230 as shown in FIG. 3C. With the rear extension distance 314 less than the minimum distance 340, the rear indexing surface 121 provides a positive stop preventing the rear extension member 122 from penetrating far enough into the opening to interfere with or impede the rotation of the engagement extension 224 away from the strap 230. Referring particularly to FIG. 3C, in one aspect of the disclosure, which may include at least a portion of the subject matter of any of the preceding and/or following examples and aspects, the front extension member 112 is longer than the rear extension member 122.

The particular size, shape or configuration of the tool 100 may be selected to suit a particular application. For example, the particular sizes of cable tie openings, pawl configurations, material(s) used to form the cable tie, or the like, may be considered to select a configuration of the tool 100 that will provide for sufficient biasing of the pawl 220 to disengage the pawl 220 from the strap 230 while not damaging the pawl 220. Similarly, different configurations of the tool 100 (e.g., actuation mechanisms such as handles or other parts of the tool 100) may be selected to fit the particular constraints of a given application (e.g., force required to move tool 100 to the closed state 360, amount of space available to insert the tool 100 proximate to the cable tie 200, or the like). Generally, the tool 100 may be designed or configured so that the front extension member 112 contacts the pawl 220 as the tool 100 is urged toward the closed state 360, such that the pawl 220 is actuated (e.g., pivoted) to disengage the pawl 220 from the teeth 233 of the strap 230 without separating, permanently deforming, or otherwise destructively impacting the pawl 220. The pawl 220 may be bent or pivoted a sufficient amount to disengage from the strap 230 but not to destroy or substantially alter the pawl 220. For example, as also indicated above, when the tool 100 is moved from the closed state 360 to the open state 350, the pawl 220 may resiliently return to or near to a previous position, such that the cable tie 220 may be re-used and/or disposed of without the creation of debris.

Referring particularly to FIG. 6, in one aspect of the disclosure, which may include at least a portion of the subject matter of any of the preceding and/or following examples and aspects, the tool 100 includes a first handle 610, a second handle 620, and a linkage 630 movably coupled to the first handle 610, the second handle 620, the front member 110, and the rear member 120. The various components may be sized and configured to allow convenient grip and/or improved leverage for releasing the cable tie 200. In some examples, the tool 100 may employ a relatively simple single pivot, for example to provide a scissoring movement. For example, a plier or scissor type tool 100 may be utilized in some embodiments. In other examples, different configurations or linkages may be employed. For example, referring particularly to FIG. 6, in one aspect of the disclosure, which may include at least a portion of the subject matter of any of the preceding and/or following examples and aspects, the linkage 630 includes a parallel movement linkage 632. When the first handle 610 and the second handle 620 are moved relative to one another, the front member 110 and the rear member 120 are moved parallel to each other. As seen in FIG. 6, the parallel movement linkage 632 may include pins 633 and arms 634 joined by the pins 633 to provide the parallel movement. Utilization of a parallel motion linkage 632 may help provide accurate, consistent placement of the extension members into the opening 211 while limiting the clearances required between the extension members and one or more aspects of the opening 211. Other tool configurations may be employed in other examples.

For example, referring particularly to FIG. 7, in one aspect of the disclosure, which may include at least a portion of the subject matter of any of the preceding and/or following examples and aspects, the tool 100 includes a resilient member 710. The front member 110 and the rear member 120 are movably connected by the resilient member 710. The resilient member 710 may be formed of a plastic or otherwise resiliently biasable material, so that the tool 100 is resiliently biasable between states. For example, the tool 100 may be moved to the closed state 360 against the resiliency of the resilient member 710, with the tool 100 resiliently returned to the open state 360 upon the removal or reduction of the force. The resilient member 710 may be generally formed as single piece (e.g., molded or cast), and the tool 100 may have inserts (e.g., of a metallic or otherwise generally rigid material) for one or more of the front extension member 112 or rear extension member 122. In the embodiment depicted in FIG. 7, the front extension member 112 is formed as an insert that can be snapped or otherwise secured to the resilient member 710. It may be noted that, in various examples, part or all of the front extension member 112 and/or the rear extension member 122 may be integrally formed as part of a shared component or structure as seen in FIG. 7. Other arrangements or configurations may be employed in various examples. In some examples, the resilient member 710 may be configured as a spring joining arms or handles coupled to the extension members and indexing surfaces of the tool 100.

It may be noted that, in various embodiments, the tool 100 may include only a single handle to which the front extension member 112 and/or the front member 110 is attached, and the rear member 120 may not be present. It may be noted that the rear member 120 assists in positioning the tool 100 during insertion and during gripping the cable tie 200, and that a tool 100 with only a single handle (e.g., not including a rear member 120) may require additional attention and/or effort from a user of the tool 100 for proper insertion of the front extension member 112, release of the strap 230 from the teeth 233, and handling of the cable tie 200 after release of the strap 230 from the teeth 233.

Referring primarily to FIGS. 1-3 and 8, one example of the present disclosure relates to a method 800 of using the tool 100 to release the cable tie 200 fastened around an object. The cable tie 200 includes the head 210, the pawl 220, and the strap 230. The head 210 includes the opening 211, with the pawl 220 movably coupled to the head 210 inside the opening 211. The strap 230 has the inner side 231 and the outer side 232 and includes the teeth 233 extending from the outer side 232 of the strap 230. The head 210 of the cable tie 200 includes the front side 212 that has the front surface 213 and the rear side 214 that has the rear surface 215. The strap 230 is configured to be inserted through the opening 211 from the front side 212 to the rear side 214 in the insertion direction 300 to engage the pawl 220 with the teeth 233. The opening 211 in the head 210 has the inner surface 217 that, when the strap 230 is inserted in the opening 211, is on the outer side 232 of the strap 230 and is facing toward the strap 230. The pawl 220 includes the contact extension 221 having the contact portion 222 spaced the distance D2 along the transverse direction 302, perpendicular to the insertion direction 300, from the inner surface 217 with the strap 230 inserted through the opening 211 and engaging the pawl 220. The method 800 includes gripping the head 210 of the cable tie 200 with the tool 100 (block 802). The method 600 also includes exerting a force on the contact portion 222 of the pawl 220 with the tool 100, wherein the force includes a first component in the insertion direction 300 and a second component perpendicular to the first component and directed toward the outer side 232 of the strap 230, and wherein the force is sufficient to disengage the pawl 220 and the teeth 233 of the strap 230 and a travel of the front extension member 112 of the tool 100 is insufficient to detach the pawl 220 from the head 210 (block 804). The method 800 also includes pulling the head 210 of the cable tie 200 away from the object with the tool 100 until the strap 230 is withdrawn from the opening 211 in the head 210 (block 808).

The tool 100 may be reconfigured from the open state 350 to the closed state 360 to grip the head 210 and to disengage the pawl 220 from the strap 230. The method 800 may be employed to non-destructively release or disengage the cable tie 200. For example, referring again to FIGS. 1-3 and 8, in one aspect of the disclosure, which may include at least a portion of the subject matter of any of the preceding and/or following examples and aspects, the travel is insufficient to damage the pawl 220 and the teeth 233 of the strap 230. The tool 100 may be designed or configured to function with one or more particular types and/or sizes of cable tie 200, with various components corresponding to one or more particular aspects of the cable tie 200 (e.g., the front extension member 112 may be configured based on the contact extension 221, and/or the force and for distance required to bias the contact extension 221 to disengage the engagement extension 224 of the pawl 220 from the teeth 233 of the strap 230; the rear extension member 122 may be sized to provide a clearance between the rear extension member 122 and the engagement extension 224 in the closed state 360, or the like).

Referring again to FIGS. 1-3 and 8, in one aspect of the disclosure, which may include at least a portion of the subject matter of any of the preceding and/or following examples and aspects, exerting the force on the contact portion 222 (block 804) includes spacing the contact portion 222 and the inner surface 217, along the transverse direction 302, by a distance D3 that is greater than the distance D2 (block 806). The contact portion 222 may be spaced by urging the front extension member 112 into the opening, with a pawl contact portion 114 of the front extension member 112 contacting the contact extension 221 of the pawl 220, and urging the contact extension 221 away from the inner surface 217 of the head 210, resulting in a pivoting of the pawl 220 that disengages the engagement extension 224 of the pawl 220 from the strap 230. Thus, by spacing the contact portion 222 from the inner surface 217 by the distance D3, the pawl 220 may pivot to release or disengage the engagement extension 224 from the teeth 233, freeing the strap 230 for removal from the head 210.

Referring again to FIGS. 1-3 and 8, in one aspect of the disclosure, which may include at least a portion of the subject matter of any of the preceding and/or following examples and aspects, pulling the head 210 of the cable tie 200 away from the object (block 808) includes pulling the tool 100 away from the object along the transverse direction 302 (block 810). Alternatively, for examples where the head 210 is disposed closed to an obstruction or impediment preventing pulling the head 210 away from the object, the head 210 may be held in place and the strap 230 pulled through the opening 211 and/or away from the object. In still other examples, the head 210 and strap 230 may be pulled away from the object.

Referring again to FIGS. 1-3 and 8, in one aspect of the disclosure, which may include at least a portion of the subject matter of any of the preceding and/or following examples and aspects, the method 800 includes continuing to grip the head 210 of the cable tie 200 with the tool 100 after withdrawing the strap 230 from the opening 211 in the head 210 (block 812). With the cable tie 200 thus securely gripped, and with the cable tie 200 non-destructively released, the cable tie 200 may be re-used or disposed without any resulting debris and increased control for any subsequent actions regarding the cable tie 200.

Referring again to FIGS. 1-3 and 8, in one aspect of the disclosure, which may include at least a portion of the subject matter of any of the preceding and/or following examples and aspects, the method 800 includes releasing the head 210 from the tool 100 and disposing the cable tie 200 in a designated location (block 814). For example, with the head 210 gripped by the tool 100 (e.g., with the tool 100 maintained in the closed state 360), the cable tie 200 may be positioned over a collection bag or receptacle, and the head 210 then released (e.g., the tool 100 actuated from the closed state 360 to the open state 350) to drop the cable tie 200 into the bag or receptacle.

Referring again to FIGS. 1-3 and 8, in one aspect of the disclosure, which may include at least a portion of the subject matter of any of the preceding and/or following examples and aspects, the method 800 includes releasing the head 210 of the cable tie 200 from the tool 100 (block 816); wrapping the strap 230 of the cable tie 200 around a second object (block 818); and inserting the strap 230 through the opening 211 in the head 210 of the cable tie 200 in the insertion direction 300 to engage the pawl 220 with the teeth 233 (block 820). Thus, in some examples, the method 800 provides for re-use of the cable tie 200. It may be noted that the second object may be entirely different from the first object, and may be remotely or distantly located from the first object. In some examples, however, all or a portion of the second object may be the same or similar to the first object. For example, the first object may be a bundle of cables. The cable tie 100 may be removed from the first object. With the cable tie removed, one or more cables may be added, removed, or changed from the bundle to modify the first object into the second object, and the cable tie 200 may be secured around the modified cable bundle. Thus, in some examples, the contents of a previously secured group of cables, for instance, may be modified while not requiring an additional cable tie and/or not resulting in any debris (e.g., from a cable tie damaged during removal or replacement).

The disclosure and drawing figure(s) describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, in some aspects of the disclosure, not all operations described herein need be performed.

Examples of the disclosure may be described in the context of an aircraft manufacturing and service method 1100 as shown in FIG. 9 and an aircraft 1102 as shown in FIG. 10. During pre-production, illustrative method 1100 may include specification and design 1104 of the aircraft 1102 and material procurement 1106. During production, component and subassembly manufacturing 1108 and system integration 1110 of the aircraft 1102 take place. Thereafter, the aircraft 1102 may go through certification and delivery 1112 to be placed in service 1114. While in service by a customer, the aircraft 1102 is scheduled for routine maintenance and service 1116 (which may also include modification, reconfiguration, refurbishment, and so on).

Each of the processes of the illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 10, the aircraft 1102 produced by the illustrative method 100 may include an airframe 1118 with a plurality of high-level systems 1120 and an interior 1122. Examples of high-level systems 1120 include one or more of a propulsion system 1124, an electrical system 1126, a hydraulic system 1128, and an environmental system 1130. Any number of other systems may be included. Although an aerospace example is shown, the principles of the invention may be applied to other industries, such as the automotive industry.

Apparatus and methods shown or described herein may be employed during any one or more of the stages of the manufacturing and service method 1100. For example, components or subassemblies corresponding to component and subassembly manufacturing 1108 may be fabricated or manufactured in a manner similar to components or subassemblies produced while the aircraft 1102 is in service. Also, one or more aspects of the apparatus, method, or combination thereof may be utilized during the production states 1108 and 1110, for example, by substantially expediting assembly of or reducing the cost of an aircraft 1102. Similarly, one or more aspects of the apparatus or method realizations, or a combination thereof, may be utilized, for example and without limitation, while the aircraft 1102 is in service, e.g., maintenance and service 1116.

Different examples and aspects of the apparatus and methods are disclosed herein that include a variety of components, features, and functionality. It should be understood that the various examples and aspects of the apparatus and methods disclosed herein may include any of the components, features, and functionality of any of the other examples and aspects of the apparatus and methods disclosed herein in any combination, and all of such possibilities are intended to be within the spirit and scope of the present disclosure.

Many modifications and other examples of the disclosure set forth herein will come to mind to one skilled in the art to which the disclosure pertains having the benefit of the teachings presented in the foregoing descriptions and the associated drawings.

Therefore, it is to be understood that the disclosure is not to be limited to the specific embodiments disclosed and that modifications and other embodiments are intended to be included within the scope of the appended claims. Moreover, although the foregoing descriptions and the associated drawings describe example embodiments in the context of certain illustrative combinations of elements and/or functions, it should be appreciated that different combinations of elements and/or functions may be provided by alternative implementations without departing from the scope of the appended claims.

What is claimed is:

1. A tool for releasing a cable tie, the cable tie including a head, a pawl, and a strap, the head including an opening, the pawl movably coupled to the head inside the opening, the strap having an inner side and an outer side and including teeth extending from the outer side of the strap, the head of the cable tie including a front side that has a front surface and a rear side that has a rear surface, the strap configured to be inserted through the opening from the front side to the rear side in an insertion direction to engage the pawl with the teeth, the head having a length equal to a maximum distance between the front surface and the rear surface along the insertion direction, the opening in the head having an inner surface that, when the strap is inserted in the opening, is on the outer side of the strap and is facing toward the strap, the head having an outer surface that, when the strap is inserted in the opening, is on the outer side of the strap and is facing away from the strap, the head having a maximum height equal to a maximum distance between the outer surface of the head and the inner surface of the opening along a transverse direction perpendicular to the insertion direction, the pawl coupled to the inner surface of the opening a distance D1 from the rear surface along the insertion direction, the pawl including a contact extension having a contact portion spaced a distance D2 along the transverse direction from the inner surface with the strap inserted through the opening and engaging the pawl, the head having a minimum height equal to a minimum distance between the outer surface of the head and the inner surface of the head along the transverse direction, the tool comprising:

a front member comprising a front indexing surface and a front extension member projecting from the front indexing surface; and a rear member movably coupled to the front member and comprising a rear indexing surface and a rear extension member projecting from the rear indexing surface;

wherein, when the tool is in an open state, a shortest distance between the front extension member and the rear extension member along the insertion direction is greater than the length of the head; and wherein, when the front member and the rear member engage the head of the cable tie with the tool in a closed state and the strap inserted through the opening, the front indexing surface of the front member contacts the front surface of the head;

the rear indexing surface of the rear member contacts the rear surface of the head;

the front extension member protrudes into the opening in the head, in the insertion direction, a front extension distance that is less than the length of the head minus the distance D1, and spaces the contact portion and the inner surface, along the transverse direction, by a distance D3 that is greater than the distance D2 and sufficient to disengage the pawl and the teeth of the strap; and the rear extension member protrudes into the opening in the head, in a direction opposite to the insertion direction, a rear extension distance that is less than the distance D1.

2. The tool of claim 1, wherein the front extension member comprises a leading edge and wherein, when the front member initially contacts the contact portion of the contact extension with the tool in an intermediate state between the open state and the closed state, the leading edge is spaced a distance D4 from the contact portion along the transverse direction, wherein the distance D4 is less than the distance D2.

3. The tool of claim 1, wherein the front extension member includes a pawl contact portion configured to contact the contact portion of the pawl, wherein, when the front member and the rear member engage the head of the cable tie with the tool in the closed state, the pawl contact portion of the front extension member is not parallel to the insertion direction.

4. The tool of claim 3, wherein the pawl contact portion comprises a planar surface.

5. The tool of claim 3, wherein the pawl contact portion comprises a non-planar surface.

6. The tool of claim 3, wherein the pawl contact portion extends along the transverse direction toward the inner surface of the head and along the insertion direction toward the rear member, wherein, when the tool is in the closed state, the pawl contact portion exerts a force on the contact portion of the pawl, the force including a first component in the insertion direction and a second component perpendicular to the first component and directed toward the outer side of the strap.

7. The tool of claim 1, wherein at least one of the front member and the rear member further includes an outer indexing surface spaced from at least one of the front extension member and the rear extension member, along the transverse direction, a minimum distance not less than the minimum height of the head and not exceeding the maximum height of the head.

8. The tool of claim 1, wherein the front extension distance is less than a minimum distance along the insertion direction from the front surface of the head to a pawl base.

9. The tool of claim 1, wherein the rear extension distance is less than a minimum distance along the insertion direction from the rear surface of the head to an engagement extension of the pawl.

10. The tool of claim 1, comprising:

a first handle;

a second handle; and a linkage movably coupled to the first handle, the second handle, the front member, and the rear member.

11. The tool of claim 10, wherein the linkage comprises a parallel movement linkage, wherein, when the first handle and the second handle are moved relative to one another, the front member and the rear member are moved parallel to each other.

12. The tool of claim 1, comprising a resilient member, wherein the front member and the rear member are movably connected by the resilient member.

13. The tool of claim 1, wherein the front extension member projects directly from the front indexing surface and the rear extension member projects directly from the rear indexing surface.

14. A method of using a tool to release a cable tie fastened around an object, the cable tie including a head, a pawl, and a strap, the head including an opening, the pawl movably coupled to the head inside the opening, the strap having an inner side and an outer side and including teeth extending from the outer side of the strap, the head of the cable tie including a front side that has a front surface and a rear side that has a rear surface, the strap configured to be inserted through the opening from the front side to the rear side in an insertion direction to engage the pawl with the teeth, the opening in the head having an inner surface that, when the strap is inserted in the opening, is on the outer side of the strap and is facing toward the strap, the pawl including a contact extension having a contact portion spaced a distance D2 along a transverse direction, perpendicular to the insertion direction, from the inner surface with the strap inserted through the opening and engaging the pawl, the method comprising:

gripping the head of the cable tie with the tool;

exerting a force on the contact portion of the pawl with the tool, wherein the force includes a first component in the insertion direction and a second component perpendicular to the first component and directed toward the outer side of the strap, and wherein the force is sufficient to disengage the pawl and the teeth of the strap and a travel of a front extension member of the tool is insufficient to detach the pawl from the head; and pulling the head of the cable tie away from the object with the tool until the strap is withdrawn from the opening in the head.

15. The method of claim 14, wherein exerting the force on the contact portion of the pawl further includes spacing the contact portion and the inner surface, along the transverse direction, by a distance D3 that is greater than the distance D2.

16. The method of claim 14, wherein pulling the head of the cable tie away from the object comprises pulling the tool away from the object along the transverse direction.

17. The method of claim 14, wherein the travel is insufficient to damage the pawl and the teeth of the strap.

18. The method of claim 14, comprising continuing to grip the head of the cable tie with the tool after withdrawing the strap from the opening in the head.

19. The method of claim 18, comprising releasing the head from the tool and disposing the cable tie in a designated location.

20. The method of claim 14, comprising:

releasing the head of the cable tie from the tool;

wrapping the strap of the cable tie around a second object; and inserting the strap through the opening in the head of the cable tie in the insertion direction to engage the pawl with the teeth.

21. The tool of claim 7, wherein the outer indexing surface is wider than the front extension member and the rear extension member.

22. The tool of claim 13, wherein the front extension member projects substantially perpendicularly from the front indexing surface and the rear extension member projects substantially perpendicularly from the rear indexing surface.

23. The tool of claim 1, wherein the front extension member is longer than the rear extension member.

24. The tool of claim 1, wherein the front extension member projects substantially perpendicularly from the front indexing surface and the rear extension member projects substantially perpendicularly from the rear indexing surface.

25. The tool of claim 1, wherein at least one of the front member and the rear member further includes an outer indexing surface spaced from at least one of the front extension member and the rear extension member, along the transverse direction, a minimum distance not less than the minimum height of the head.

26. The tool of claim 3, wherein the pawl contact portion includes one or more planar surfaces and one or more non-planar surfaces.

27. The tool of claim 11, wherein:

the parallel movement linkage includes pins and arms and the arms are joined by the pins so that the front member and the rear member are movable parallel to each other.

* * * * *